US008707939B2

(12) United States Patent
Chu

(10) Patent No.: US 8,707,939 B2
(45) Date of Patent: Apr. 29, 2014

(54) PERCUSSION AND MAGAZINE REVOLVING DEVICE OF TOY GRENADE LAUNCHER

(75) Inventor: Chen Tang Chu, Taichung (TW)

(73) Assignee: I Chih Shivan Enterprise Co., Ltd., Taichung (TW)

( * ) Notice: Subject to any disclaimer, the term of this patent is extended or adjusted under 35 U.S.C. 154(b) by 434 days.

(21) Appl. No.: 13/235,520

(22) Filed: Sep. 19, 2011

(65) Prior Publication Data

US 2013/0068207 A1 Mar. 21, 2013

(51) Int. Cl.
*F41B 11/54* (2013.01)

(52) U.S. Cl.
USPC ..... 124/45

(58) Field of Classification Search
USPC ..... 124/45, 46, 48, 51.1, 52; 42/105, 19, 60
See application file for complete search history.

(56) References Cited

U.S. PATENT DOCUMENTS 5,535,729 A * 7/1996 Griffin et al. ..... 124/66
5,596,978 A * 1/1997 Johnson et al. ..... 124/72
8,430,085 B2 * 4/2013 Tippmann et al. ..... 124/73
8,517,005 B2 * 8/2013 Chu ..... 124/65
2012/0037138 A1 * 2/2012 Huebl ..... 124/56

* cited by examiner

*Primary Examiner* — Gene Kim
*Assistant Examiner* — Amir Klayman
(74) *Attorney, Agent, or Firm* — Leong C. Lei

(57) ABSTRACT

A percussion and magazine revolving device of toy grenade launcher includes a magazine. The magazine forms annularly arranged cylindrical accommodation chambers receiving therein grenades and has a circumference along which holding pegs are arranged. A release plate is attached to the magazine and forms a pawl for selective engagement with the holding pegs. A trigger and a percussion mechanism coupled to the trigger are arranged on a carrier seat. The percussion mechanism has a top edge o which a drive bar is mounted. The magazine is rotated to compress an elastic element arranged therein. When the trigger is pulled, the percussion mechanism is caused to fire one grenade, and at the same time, the drive bar pushes the release plate away to make the pawl disengaging the holding pegs, thereby allowing the magazine to rotate an angle for being ready to fire the next grenade.

6 Claims, 10 Drawing Sheets

PERCUSSION AND MAGAZINE REVOLVING DEVICE OF TOY GRENADE LAUNCHER

TECHNICAL FIELD OF THE INVENTION

The present invention generally relates to a percussion and magazine revolving device of toy grenade launcher, and more particularly to a percussion and magazine revolving device that causes a firing mechanism to launch grenades when a trigger is pulled and at the same time automatically revolves a magazine by an angle to achieve an effect of launching grenades in succession.

DESCRIPTION OF THE PRIOR ART

Toy guns that are used in survival games for shooting with BB bullets or paintballs are made so real and also exciting, making them widely popular and appealing to the general people. The toy guns that are available in the market for shooting BB bullets or paintballs are often structured for shooting only BB bullets and paintballs in succession. This lowers the interesting and exciting of playing the game. Apparently, a grenade launcher that may simultaneously shoot a number of BB bullets or paintballs provides a strong and heavy fire and is thus more appealing to the game players. One solution is to load a grenade cartridge that contains a number of BB bullets or paintballs and a pressure accumulation structure of compressed air in a grenade launcher and then activate a trigger of the grenade launcher to launch the grenade cartridge so that the compressed air released from the pressure accumulation structure instantaneously project the BB bullets or the paintballs. However, the structure of grenade that is currently adopted is very complicated and further, launcher is made in a structure of single shot. This cannot satisfy the game players who place a strong demand for more advanced firearms.

In view of the above discussed problem, the present invention aims to provide an improved percussion and magazine revolving device of toy grenade launcher that allows successive launch or firing of the launcher and provides easy and convenient use and operation.

SUMMARY OF THE INVENTION

The primary objective of the present invention is to provide a percussion and magazine revolving device of toy grenade launcher, which causes a percussion mechanism to launch grenades when a trigger of the launcher is pulled and at the same time automatically revolves a magazine by an angle to achieve an effect of launching grenades in succession.

The percussion and magazine revolving device of toy grenade launcher comprises generally a magazine, a trigger, and a percussion mechanism coupled to the trigger. The magazine comprises a plurality of annularly arranged cylindrical accommodation chambers and an elastic element at the center thereof and has a circumference along which holding pegs are arranged in a spaced manner and has a top side to which a release plate is attached. The release plate forms a pawl for selective engagement with the holding pegs. The trigger and the percussion mechanism are arranged on a carrier seat. The percussion mechanism has a top edge o which a drive bar is mounted. The cylindrical accommodation chambers of the magazine receive grenades to load therein. The magazine is then rotated to compress the elastic element. When the trigger is pulled, the percussion mechanism is caused to fire one of the grenades, and at the same time, the drive bar pushes the release plate away to make the pawl disengaging the holding pegs, thereby allowing the magazine to rotate an angle for being ready to fire the grenade of the next one of the cylindrical accommodation chambers so as to achieve successive firing of grenades.

In the percussion and magazine revolving device of toy grenade launcher discussed above, the percussion mechanism forms an elongate horizontal slot, and the carrier seat comprises a constraint pin, wherein the constraint pin is received in the elongate horizontal slot, so that when the trigger is pulled, the percussion mechanism is cause to make a horizontal movement to activate a firing operation of grenade.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
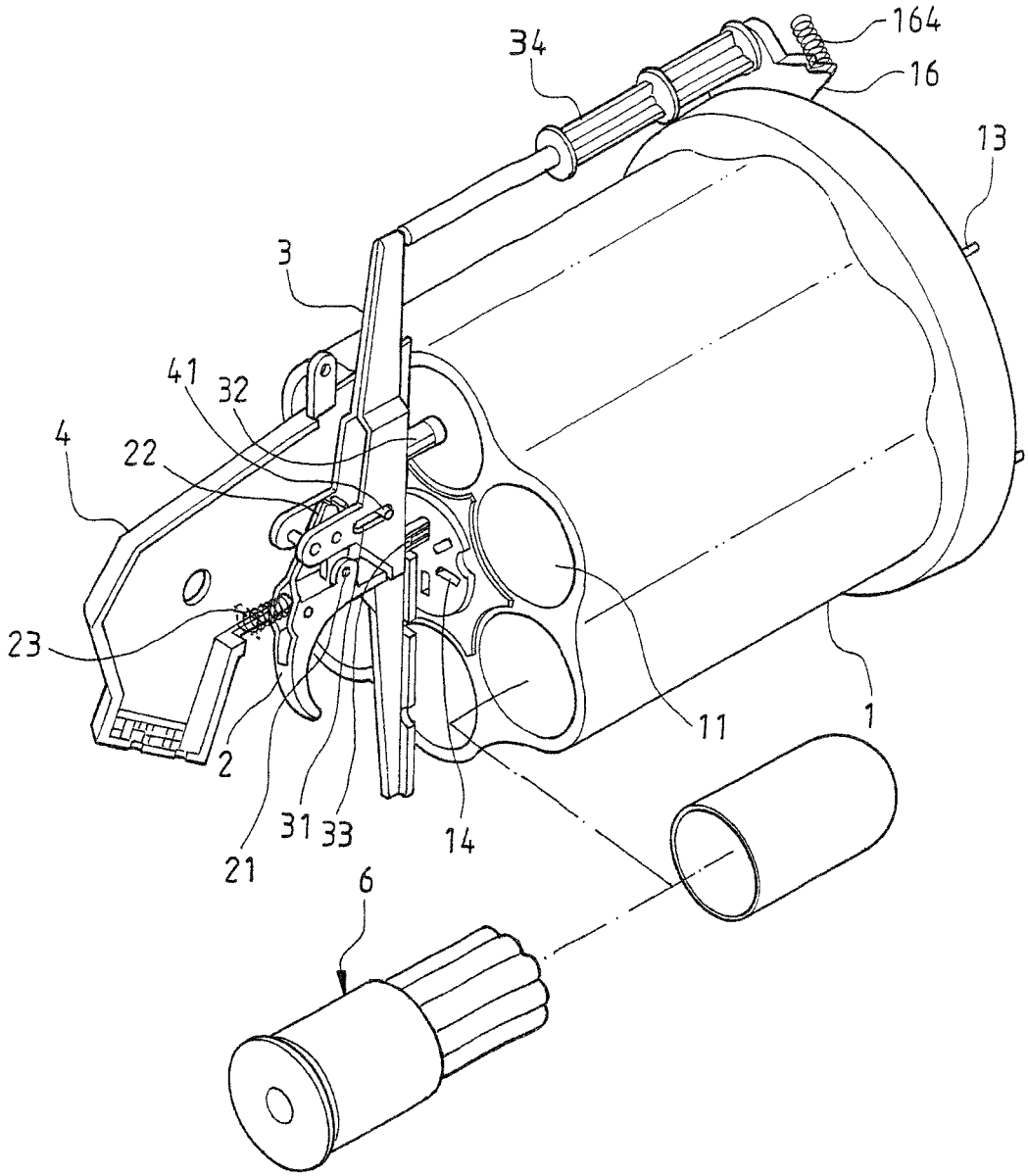
FIG. 1 is a perspective view of the present invention.

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 1, 2, 3, and 3A, which are respectively a perspective view and a front view of the present invention and a side elevational view and an exploded view of a grenade launcher to which the present invention is applied, the present invention comprises a magazine 1, a trigger 2, and a percussion mechanism 3 coupled to the trigger 2. The magazine 1 comprises a plurality of annularly arranged cylindrical accommodation chambers 11, of which a center is fit over a box 12. The box 12 contains therein a power spring like elastic element and further, a movable positioning bar 121 is arranged at a center of the box 12 in such a way that the positioning bar 121 extends through a fixation disk 51 of the grenade launcher 5 and coupled to a U-shaped pull bar 122. The magazine 1 has an end having a circumference along which a plurality of holding pegs 13 is arranged in a spaced manner. The box forms positioning slots 14 that are arranged in a radiating fashion and correspond to the cylindrical accommodation chambers 11. Attached to a top edge of the fixation disk 51 are a release plate seat 15, which forms a circular hole 151, and a release plate 16. The release plate 16 is mounted to the release plate seat 15 by a mounting pivot 161 in a swinging manner and forms a circular hole 162. The release plate has a bottom forming a pawl 163 and the pawl 163 has a top to which a spring 164 is mounted in such a way that an opposite end of the spring 164 is retained by a top edge of release plate seat 15. The release plate 16 has a top edge that forms an operation lever 165 projecting beyond and thus exposed outside the release plate seat 15.

The magazine 1, after being fit over and fixed to the box 12, can be rotated out of the grenade launcher 5 to allow grenades to be placed into the cylindrical accommodation chambers 11. And, then the magazine 1 can be rotated back on the positioning disk 52 of the grenade launcher 5 so as to allow the positioning bar 121 to fit into a central hole 521 of the positioning disk 52 to get ready for firing.

The trigger 2 is mounted by a mounting pivot 21 to a carrier seat 4 so as to be rotatable for trigger pulling as being supported by the mounting pivot 21. The trigger carries a push bar 22 thereon and has a rear end to which a spring 23 is attached so that after being pulled, the trigger is allowed to return to the original position by the spring force of the spring 23.

The percussion mechanism 3 is arranged on the carrier seat 4 and is pivoted to the trigger 2. The percussion mechanism 3 forms an elongate horizontal slot 31. The carrier seat 4 comprises a constraint pin 41 that is received in the elongate horizontal slot 31, so that the trigger 2, when being pulled, drives the percussion mechanism 3 to move in a horizontal direction. The percussion mechanism comprises a striker bar 32 and a positioning tab 33 arranged at the front side of the percussion mechanism and a drive bar 34 is arranged at the top side of the percussion mechanism. The drive bar 34 has a front end that forms a tapering tip With the above described components being properly assembled, a percussion and magazine revolving device of the toy grenade launcher is formed and can be assembled to a grenade launcher 5. The cylindrical accommodation chambers 11 of the magazine 1 may receive and hold therein grenades 6. By rotating the magazine 1, the elastic element contained in the box 12 is compressed. The release plate 16 pressed down by the spring 164 to have the pawl 163 engages and thus fixes one of the holding pegs 13 of the magazine 1. When the trigger 2 is pulled, the percussion mechanism 3 is caused to make a horizontal movement to have the positioning tab 33 fit into and fix the corresponding one of the positioning slots 14 and the striker bar 32 fires the grenade. After firing, the drive bar 34 is driven into the circular hole 162 of the release plate 16 to cause the pawl 163 to raise upward, thereby allowing the magazine 1 to rotate by an angle for being ready to fire the grenade 6 of the next cylindrical accommodation chamber and thus realizing successive firing of the grenades 6.

Figure 4:
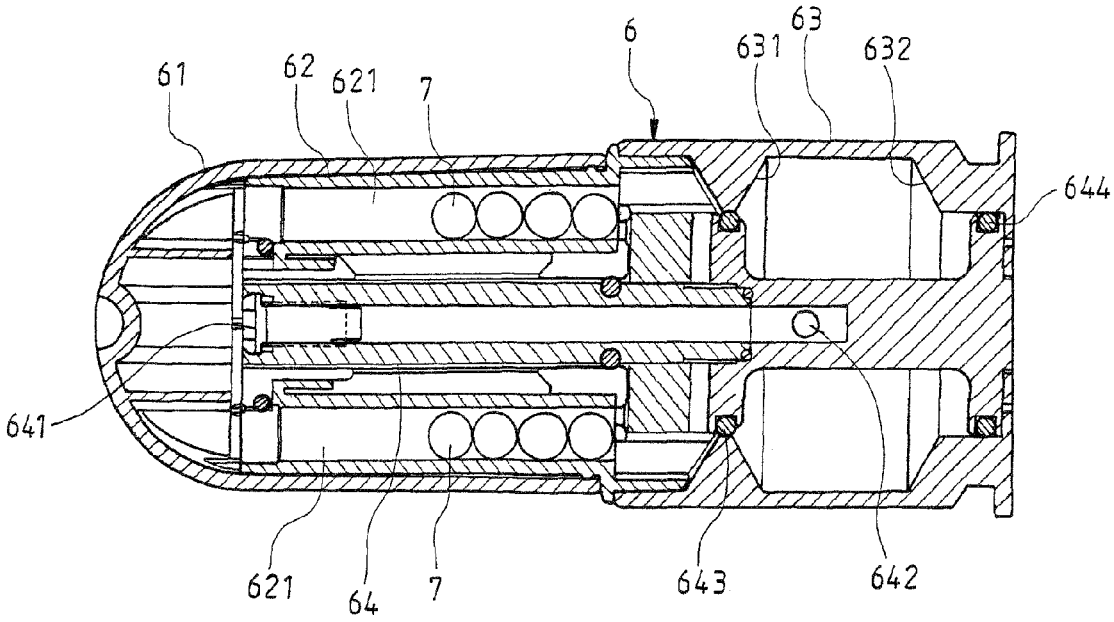
FIG. 4 is a cross-sectional of a grenade according to the present invention.

Referring to FIG. 4, which is a cross-sectional of a grenade according to the present invention, as shown in the drawing, the grenade 6 according to the present invention comprises a front cap 61, a bullet chamber 62, a storage chamber 63, and an actuation rod assembly 64. The bullet chamber 62 comprises a plurality of annularly arranged accommodation cylinders 621 for receiving therein BB bullets or paintballs 7. The storage chamber 63 forms circumferential raised walls 631, 632. The actuation rod assembly 64 is of a hollow structure, having a front end forming an air inlet 641 that comprises a check valve and a rear end forming an air outlet 642 and carrying annular gasket rings 643, 644. The gasket rings 643, 644 are respectively set in engagement with the raised walls 631, 632 so as to hermetically enclose the storage chamber 63. Compressed or pressurized air is fed through the air inlet 641 so that the compressed air is discharged from the air outlet 642 to accumulate in the storage chamber 63. In firing, the actuation rod assembly 64 is moved forward to move the gasket rings 643 away from the raised walls 631, so that the compressed air inside the storage chamber 63 is released to instantaneously eject the BB bullets or the paintballs 7 received in the bullet chamber 62.

Figure 3:
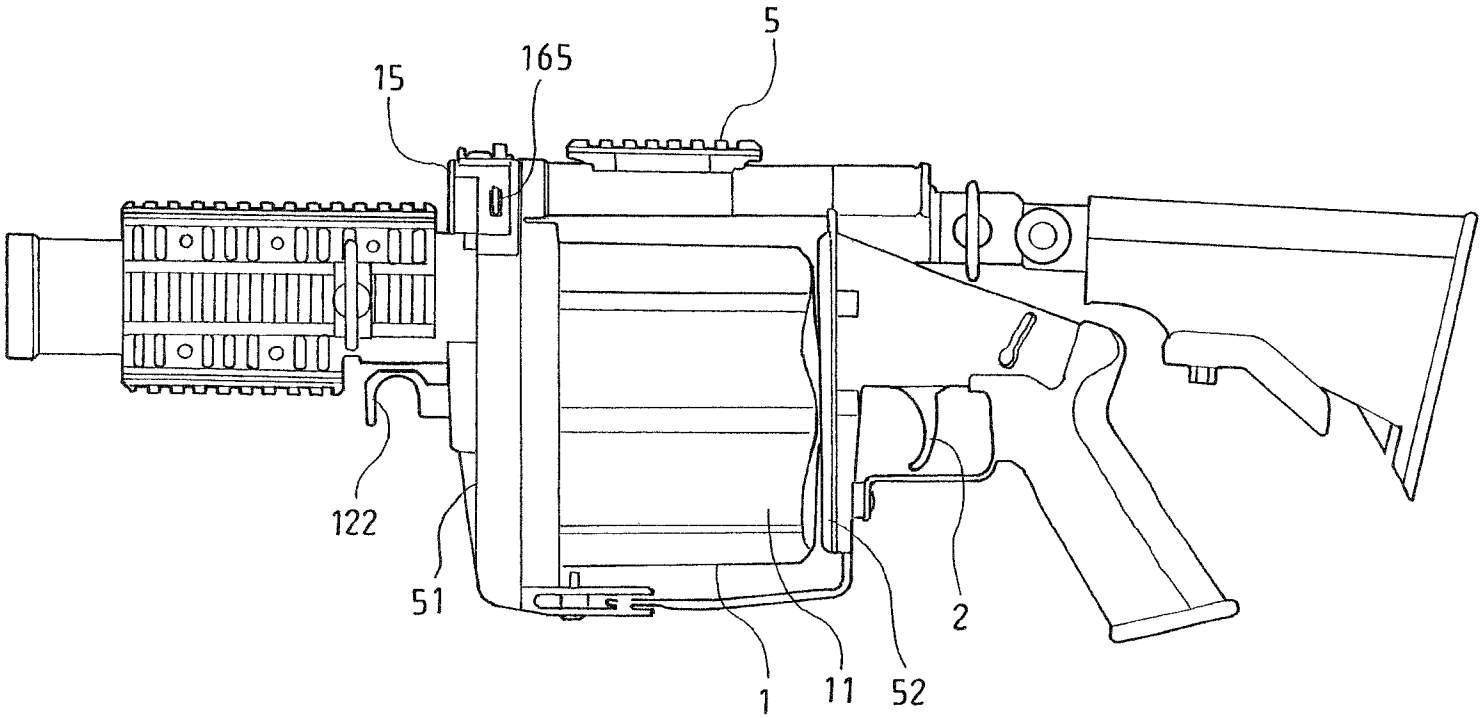
FIG. 3 is a side elevational view of a grenade launcher to which the present invention is applied.
Figure 3A:
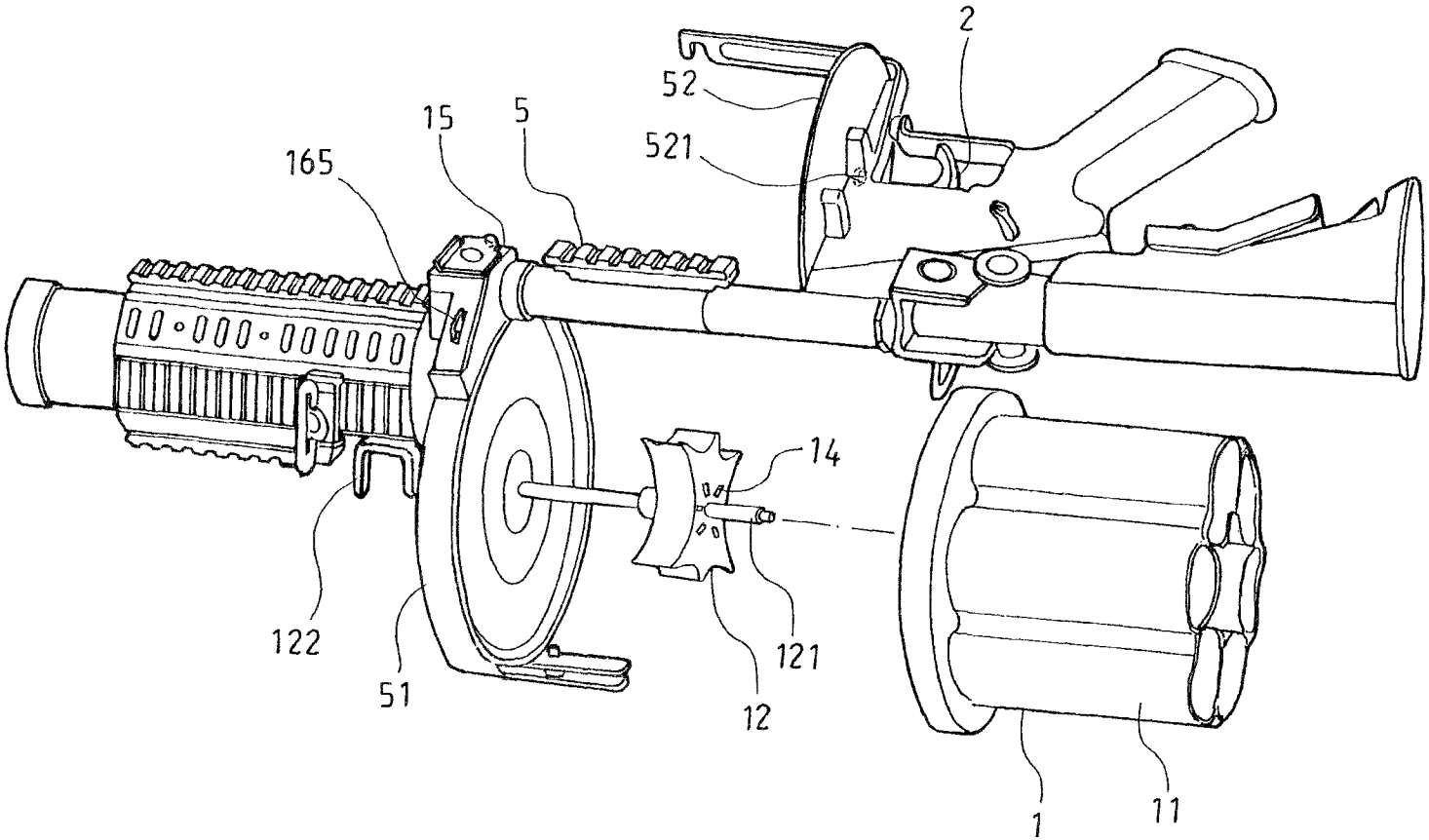
FIG. 3A is an explode view of the grenade launcher to which the present invention is applied.
Figure 4A:
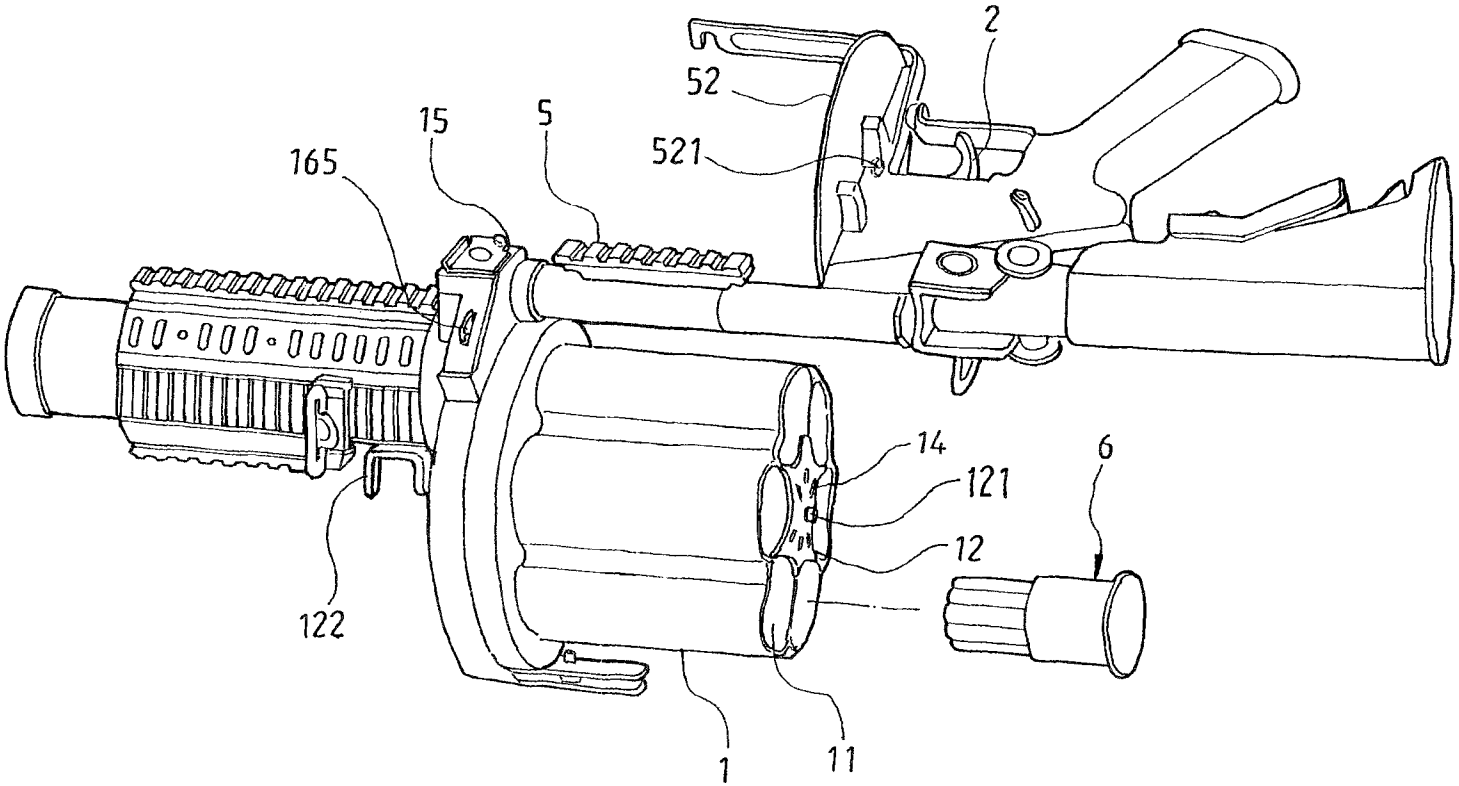
FIG. 4A is a perspective view illustrating loading of grenades according to the present invention.

Referring to FIG. 4A, which is a perspective view illustrating loading of grenades according to the present invention, reference being also made to FIG. 3A, as shown in the drawings, to use the present invention, the U-shaped pull bar 122 is pulled frontward to separate the positioning bar 121 from the central hole 521 of the positioning disk 52 of the grenade launcher 5 so that the magazine 1 may then be allowed to turn outward to one side to expose the cylindrical accommodation chambers 11, wherein grenades 6 are allowed to put into the cylindrical accommodation chambers 11 of the magazine. Afterwards, the magazine 1 is pushed backward to make the positioning bar 121 fit into the central hole 521 of the positioning disk 52 again, assuming a ready to fire condition.

Figure 2:
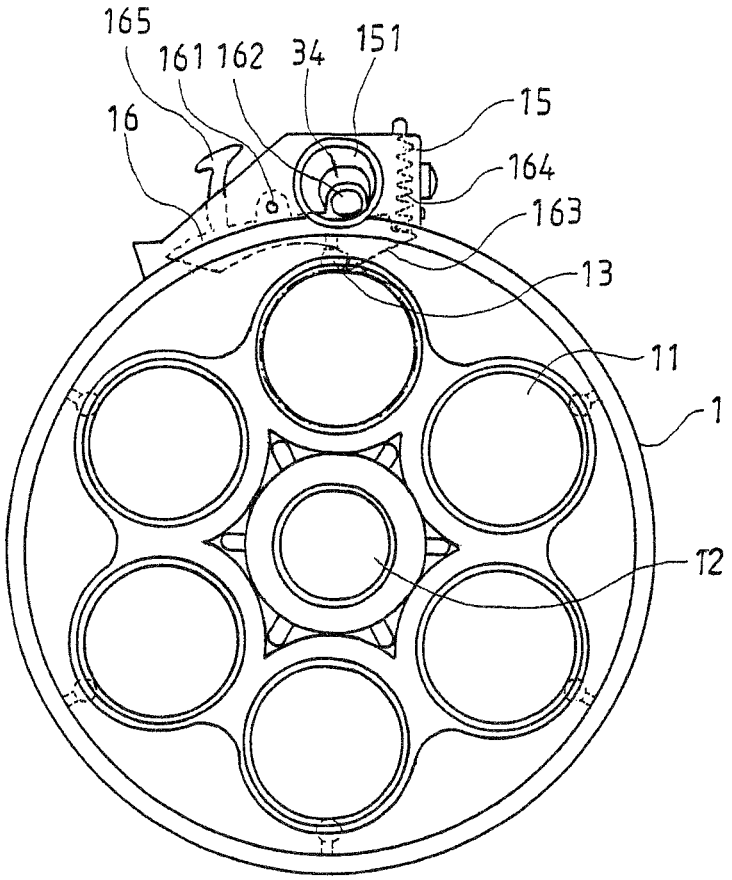
FIG. 2 is a front view of the present invention.
Figure 5:
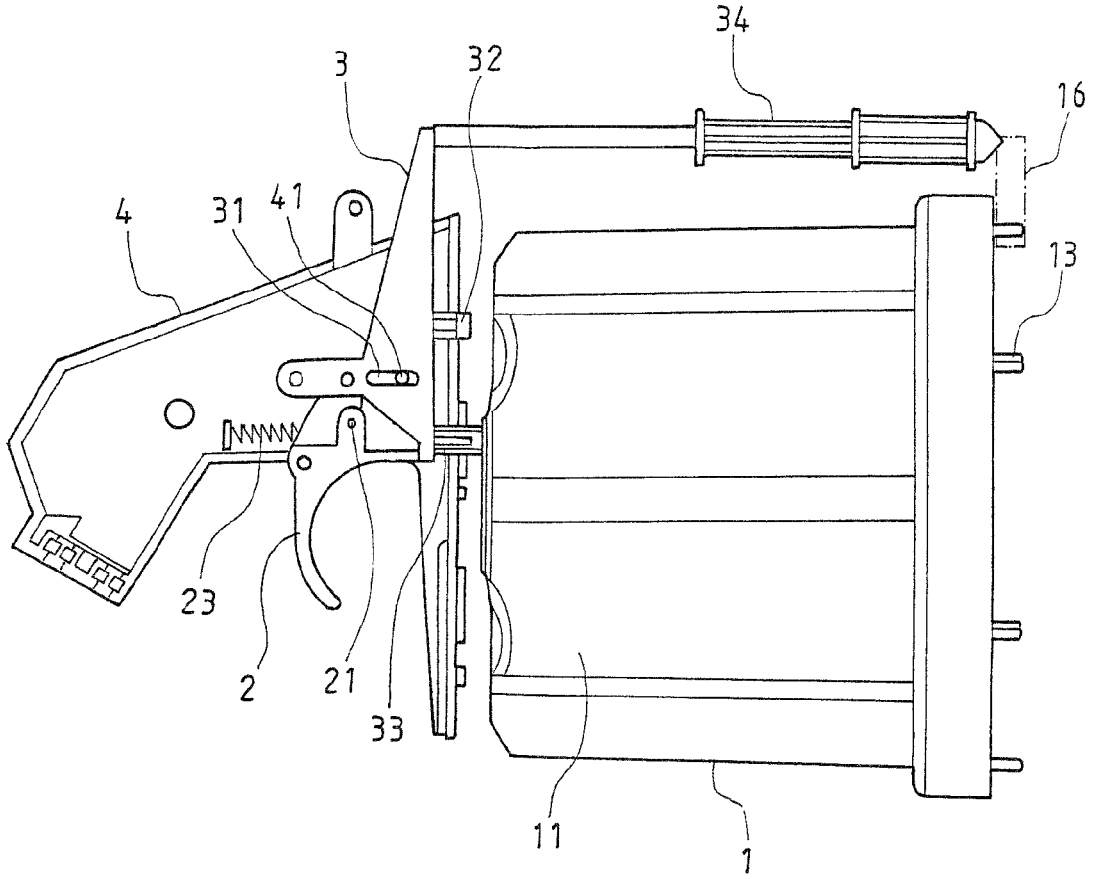
FIGS. 5 and 5A are a side elevational view and a partial perspective view illustrating an un-fired condition of the present invention.
Figure 5A:
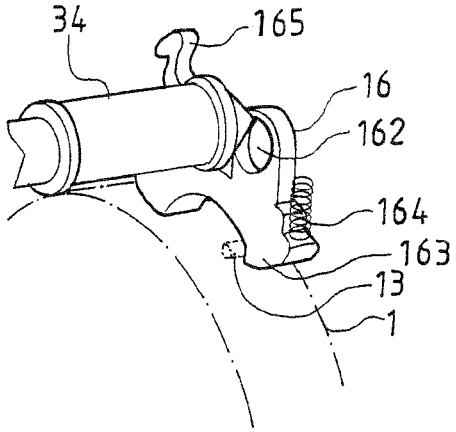

Referring to FIGS. 5 and 5A, which are a side elevational view and a partial perspective view illustrating an un-fired condition of the present invention, reference being also made to FIG. 2, as shown in the drawings, in a normal condition of the present invention, the percussion mechanism 3 is set in a rearward position with the drive bar 34 on the top side thereof disengaging from the circular hole 162 of the release plate 16 so as to allow the pawl 163 to be depressed downward by the spring force of the spring 164 to engage and thus retain the holding pegs 13 in position.

Figure 6A:
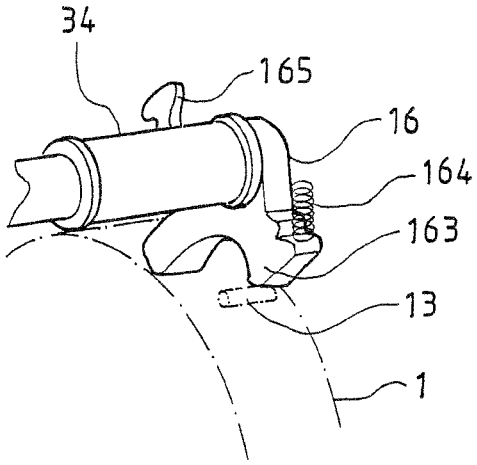
FIGS. 6A and 7 are respectively a partial perspective view and a front view illustrating revolving of the magazine according to the present invention.
Figure 6:
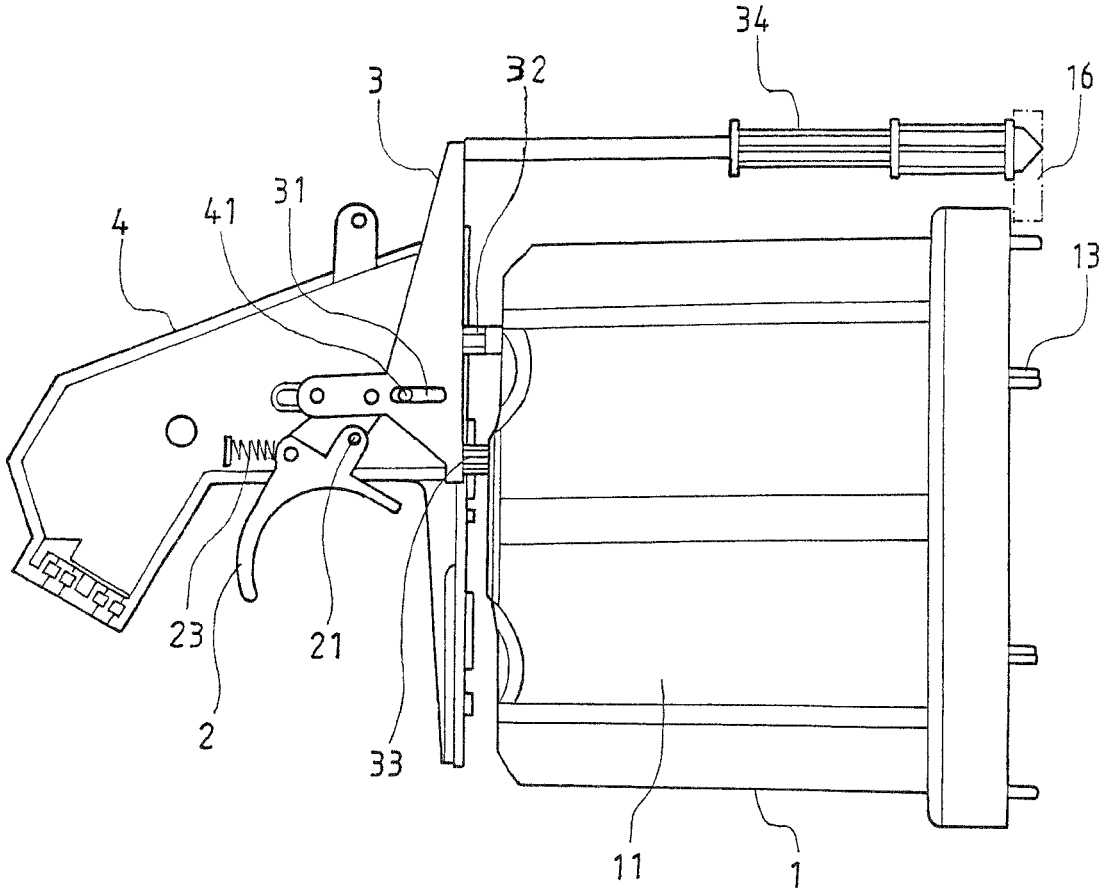
FIG. 6 is a side elevational view illustrating a firing condition of the present invention.

Referring to FIG. 6, which is a side elevational view illustrating a firing condition of the present invention, reference being also made to FIG. 4, as shown in these drawings, to fire the present invention, a user pulls the trigger 2 to cause a horizontal movement of the percussion mechanism 3. After the movement, the positioning tab 33 is fit into the corresponding one of the positioning slots 14 to thereby retain the magazine 1 in position. Then, the striker bar 32 dries the actuation rod assembly 64 of the corresponding grenade 6 to cause the gasket ring 643 to separate from the raised wall 631, thereby allowing the compressed air stored in the storage chamber 63 to be released and instantaneously eject the BB bullets or paintballs 7 contained in the bullet chamber 62.

Figure 7:
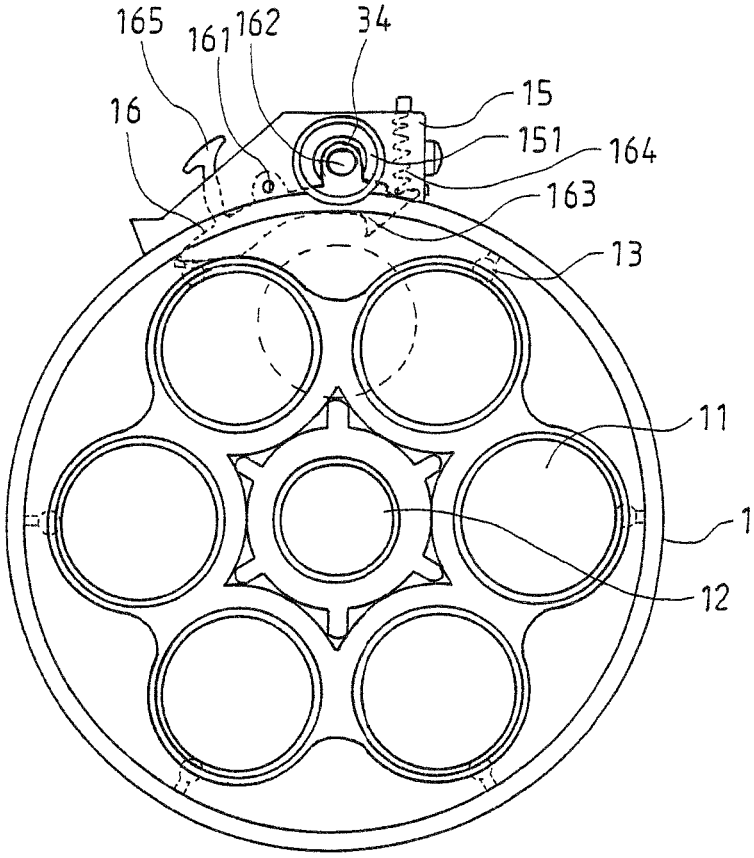

Referring to FIGS. 6A and 7, which are respectively a partial perspective view and a front view illustrating revolving of the magazine according to the present invention, as shown in the drawings, during the firing operation of the present invention, the drive bar 34 is driven forward by the percussion mechanism 3 to engage the circular hole 162 of the release plate 16 arranged on the top side of the magazine 1 so as to cause the pawl 163 to raise upward and disengaging the pawl 163 from the holding pegs 13, whereby the magazine 1 is allowed to rotate, as being driven by the spring force of the box 12, by an angle, and afterwards, the spring 164 provides a depression spring force that causes the pawl 163 to move downward and engage one of the holding pegs 13 to get ready for firing the grenade of the next cylindrical accommodation chamber 11 thereby realizing successive firing of the grenades. After the trigger 2 is released following the firing operation, the spring 23 returns the trigger back to the original position so that the percussion mechanism 3 is simultaneously pulled backward (as shown in the condition of FIG. 5), whereby the force that drives the drive bar 34 disappears and the release plate 16 is caused to move downward by the depression of the spring 164. Since the drive bar 34 has a tapering front top, the release plate 16 applying a force thereto may cause the circular hole 162 to force the drive bar 34 back to the original position (as shown in the condition of FIG. 5A). In case that the above described operation fails to revolve the magazine 1 after firing, manual operation may be made to pull the operation lever 165 for causing the pawl 163 to raise upward and then the operation lever 165 is timely released to allow the magazine 1 to just rotate by a desired angle.

In summary, according to the present invention, the percussion mechanism is combined with a rotatable the magazine, as well as retention by pawl realized in synchronization with the percussion mechanism, so as to form a percussion and magazine revolving device of top grenade launcher, whereby when the trigger is pulled, the grenade launcher may cause the percussion mechanism to launch a grenade and also cause the magazine to rotate by an angle for achieving successive firing of grenades.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A percussion and magazine revolving device of toy grenade launcher, comprising:

a grenade launcher, which comprises at least a fixation disk and a positioning disk, the positioning disk forming a central hole;

a magazine, which comprises a plurality annularly arranged cylindrical accommodation chambers for receiving grenades loaded therein and has an end surface having a circumference along which a plurality of spaced holding pegs is arranged, the magazine having a top to which a release plate is mounted in a swinging manner, the release plate having upper and lower portions respectively forming a circular hole and a pawl;

a box, which is fit to a center of the magazine and contains therein an elastic element and comprises a movable positioning bar arranged at a center thereof, the positioning bar being set to extend through the fixation disk of the grenade launcher to couple to a pull bar, whereby the positioning bar is set in the central hole of the positioning disk of the grenade launcher and is separable from the central hole to allow the magazine to be selectively turned outward for facilitating loading of the grenades into the cylindrical accommodation chambers;

a trigger, which is mounted to a carrier seat by a mounting pivot to be rotatable for trigger pulling;

a percussion mechanism, which is arranged on the carrier seat and is pivoted to the trigger and has a front side to which a striker bar is mounted and a top side to which a drive bar is mounted, the drive bar having a front end forming a tapering tip;

With the above described components properly assembled, rotation of the magazine causes the elastic element of the box to compress, the pawl of the release plate being set to engage and thus retain the holding pegs of the magazine in position, the striker bar being driven to fire a grenade, wherein after the firing, the drive bar pushes the circular hole of the release plate to disengage the pawl from the holding pegs, thereby allowing the magazine to rotate by an angle for being ready for firing a grenade in the next one of the cylindrical accommodation chambers and thus realizing successive firing of the grenades.

2. The percussion and magazine revolving device according to claim 1, wherein the box fit to the center of the magazine forms positioning slots that are arranged in a radiating fashion and correspond to the cylindrical accommodation chambers, whereby when the trigger causes a horizontal movement of the percussion mechanism, a positioning tab is fit into the hole for retaining the magazine in position.

3. The percussion and magazine revolving device according to claim 1, wherein, the trigger is mounted by a mounting pivot to a carrier seat, so that the mounting pivot is rotatable about a support point realized by the mounting pivot.

4. The percussion and magazine revolving device according to claim 1, wherein the percussion mechanism forms an elongate horizontal slot, the carrier seat comprising a constraint pin, the constraint pin being received in the elongate horizontal slot, so that when the trigger is pulled, the trigger causes a horizontal movement of the percussion mechanism.

5. The percussion and magazine revolving device according to claim 1, wherein the magazine has a top side where a release plate seat is arranged, the release plate seat forming a circular hole, the release plate being rotatably mounted by the mounting pivot to the release plate seat in a swinging manner.

6. The percussion and magazine revolving device according to claim 1, wherein the trigger has a rear end to which a spring is attached so that after being pulled, the trigger and the percussion mechanism are returned to original position by the spring force of the spring.

* * * * *